United States Patent [19]

Bock et al.

[11] 4,211,063

[45] Jul. 8, 1980

[54] METHOD AND DEVICE FOR CLEANING SPINNING ROTORS IN OPEN-END SPINNING MECHANISM

[75] Inventors: Erich Bock; Erwin Braun; Burkhard Wulfhorst, all of Ingolstadt, Fed. Rep. of Germany

[73] Assignee: Schubert & Salzer, Ingolstadt, Fed. Rep. of Germany

[21] Appl. No.: 926,284

[22] Filed: Jul. 20, 1978

[30] Foreign Application Priority Data

Aug. 5, 1977 [DE] Fed. Rep. of Germany ..... 2735113

[51] Int. Cl.[2] ..... D01H 1/12; D01H 11/00

[52] U.S. Cl. ..... 57/302; 57/304

[58] Field of Search ..... 57/34 R, 56, 302, 304

[56] References Cited

U.S. PATENT DOCUMENTS

| | | | |
|---|---|---|---|
| 3,524,312 | 8/1970 | Landwehrkamp | 57/56 |
| 3,597,911 | 8/1971 | Schiltknecht | 57/56 |
| 3,760,577 | 9/1973 | Kihara et al. | 57/302 |
| 3,796,034 | 3/1974 | Grau | 57/56 |
| 3,895,483 | 7/1975 | Grau | 57/56 |
| 4,057,955 | 11/1977 | Roehrich | 57/56 |
| 4,058,963 | 11/1977 | Stahlecker | 57/56 |

FOREIGN PATENT DOCUMENTS 2457034 6/1976 Fed. Rep. of Germany .

*Primary Examiner*—Donald Watkins
*Attorney, Agent, or Firm*—Bailey, Dority & Flint

[57] ABSTRACT

A method and device for cleaning a rotor in an open-end spinning machine. While the rotor is running at a speed less than the normal r.p.m. a first flow of cleaning air is directed to a collecting groove of the rotor and a second flow of cleaning air is simultaneously directed to the periphery of the spinning rotor at an angle different from the first flow of air. In one embodiment, at least one of the flows of air is directed in a pulsating manner. The flows or streams of air are fed through ducts provided in an extension of a cover which extends within the rotor or is supplied to the rotor by means of a movable housing.

18 Claims, 6 Drawing Figures

64
65
25
250
26
133
134
23
240
241
24
242
13
68
41
31
22
200
12
15
20
21
2
2
201
53
5
52
6

METHOD AND DEVICE FOR CLEANING SPINNING ROTORS IN OPEN-END SPINNING MECHANISM

BACKGROUND OF THE INVENTION

The present invention refers to a method of cleaning spinning rotors in open-end spinning mechanisms in which at reduced rotor r.p.m. a flow of cleaning air is directed at the collecting groove in the spinning rotor, as well as a device for the performance of the method.

the practive is known of directing through a cleaning channel a flow of cleaning air at the collecting groove in the spinning rotor in order thereby to loosen the trash adhering in the collecting groove in the spinning rotor and then to carry it away, West German A/S 1560301. It has been shown that one does not succeed in cleaning the collecting groove satisfactorily with a flow of air of that kind and carrying away the trash without part of it being deposited in the spinning rotor. The same applies to mechanical means for detaching adherent trash, West German O/S 2457034. Mechanical means of cleaning have in practice likewise been unable to stand the test. That is, if these means of cleaning are too hard the risk exists of damaging the spinning rotor, whereas if they are too soft they wear out too rapidly and very quickly become ineffective and must therefor be continuously adjusted. Furthermore very accurate timing is necessary between braking the rotor and putting the wiper into service. Such a solution is also costly and trouble-prone.

SUMMARY OF THE INVENTION

The problem is solved in accordance with the invention if a second flow of cleaning air is directed at the inner periphery of the spinning rotor, the two flows of cleaning air being directed into the spinning rotor at different angles to the tangents applied to the inner circumference. Preferably the two flows of cleaning air are directed essentially in divergent directions. It has proved that in this way not only is satisfactory loosening of the ttash from the rotor wall achieved, but even with the spinning rotor not yet stationary, positive carrying away of the detached trash is made possible. In order to intensify this effect further, in accordance with the invention, at least one of the two air flows is fed to the spinning rotor pulsatingly.

For performance of the method, in accordance with the invention there is used an open-end spinning mechanism which exhibits a first mouth of a compressed air duct directed into the interior of the spinning rotor towards the collecting groove and also a second mouth of a compressed air duct, likewise directed at the inner periphery of the spinning rotor, the two mouths being directed into the spinning rotor at different angles and the two mouths being preferably directed towards the inner periphery of the spinning rotor in divergent directions, and a common compressed air control device being associated with both mouths.

In order to be able to clean not only the collecting groove but also the open edge of the rotor, in accordance with a further feature of the invention, one mouth of a compressed air duct is directed towards the inner surface of the spinning rotor in proximity to its open edge.

For intensification of the action of the air flows, a pulsating air flow is provided in at least one of the two mouths.

the carrying away of the trash can be effected in different ways. For example, the shank of the rotor may be made as a hollow shank and connected to a suction air pipe. Or else the cover may exhibit an exhaust air opening through which the loosened trash gets carried away. In that case a cover which covers over the spinning rotor in normal service can be utilized, or the cover can be formed by a unit which for maintenance travels to the spinning station and during maintenance extends over the spinning rotor instead of the normal cover. But in accordance with a particularly simple embodiment of the invention the loosened trash is carried away over the edge of the rotor, in which case the cover advantageously has an extension projecting into the interior of the spinning rotor, such that along one part of its periphery at least at the level of the open edge of the spinning rotor it exhibits a greater clearance from the edge of the rotor than along the remainder of its periphery. Hence the trash gets carried away by means of a suction air pipe acting outside the spinning rotor, which, for example, generates the usual reduced pressure for spinning too.

In this case a separate suction air pipe is not necessary. Advantageously the extension to the cover exhibits this greater clearance from the edge of the rotor in the region of the periphery which is arranged at an obtuse angle to at least one of the mouths, in which case the greater clearance of the extension to the cover may be made as an undercut from the edge of the rotor. This undercut may also lie in the region of the mouth of the fiber feed channel, so that the undercut extension to the cover acts as a separator of the trash from the fibers.

In order to prevent the flows of cleaning air from being able to act when the cover of the rotor housing is open, which my lead to disturbance of the sliver in front of it and of the adjacent spinning stations, a switch mechanism is provided, which is associated with the cover closing the spinning rotor and is connected controlwise to the compressed air control device.

In order to achieve effective conveyance of the trash away, the flows of cleaning air are effective at reduced rotor r.p.m. The spinning rotor must consequently be slowed down in its r.p.m. This is done in known manner by a brake mechanism. Although this may be independent of the compressed air control device, the brake mechanism associated with the spinning rotor is advantageously connected controlwise to the compressed air control device, so that in a simply way synchronization can be achieved between braking of the rotor and rotor cleaning. Preferably, the triggering of the compressed air control device is effected from the yarn monitor, which for this purpose is connected controlwise via the brake mechanism to the compressed air control device.

The object of the invention is simple in construction and not susceptible to disturbances since the cleaning is effected not mechanically but pneumatically. Through the flows of cleaning air both rebounding from the inner wall of the rotor at different angles, satisfactory and intensive cleaning of the spinning rotor is achieved. Most of the parts of the device in accordance with the invention are contained in the usual spinning mechanisms, so that it is possible without great cost to modify already existing open-end spinning mechanisms in such a way that they are suitable for the performance of the method in accordance with the invention.

Accordingly, it is an object of the present invention to provide a method and device which cleans spinning rotors of trash and dirt.

Still another important object of the present invention is to provide a simple method and device which cleans trash from rotors of spinning machines that requires no adjustments.

Still another important object of the present invention is to provide a device for cleaning a rotor of an open-end spinning machine which cleans a collecting groove provided in the rotor, as well as the inner surfaces of the spinning rotors.

These and other objects and advantages of the invention will become apparent upon reference to the following specification, attendant claims and drawings.

DESCRIPTION OF A PREFERRED EMBODIMENT

Figure 3:
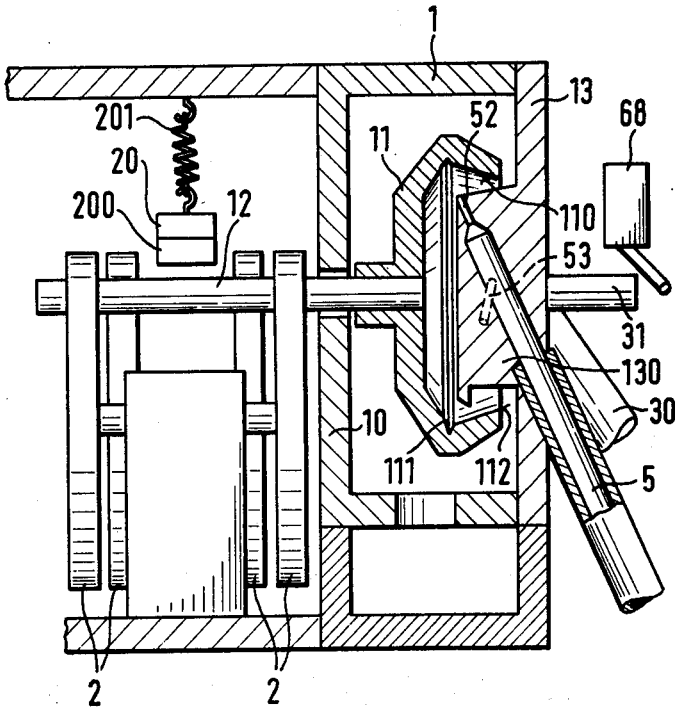
FIG. 3 is a cross-sectional view illustrating a spinning mechanism constructed in accordance with the present invention.

First of all with the aid of FIG. 3, the construction of the usual open-end spinning mechanism is described. In a housing 1 there is arranged a spinning rotor 11 the shank 12 of which projects through the rear wall 10 of the housing and is carried by supporting disks 2. The housing 1 and the open side of the spinning rotor 11 are covered over by a cover 13 which has an extension 130 projecting into the open side of the spinning rotor 11. The extension 130 from the cover holds the fiber feed tube 30 through which a sliver which is opened into individual fibers by a feeding and opening mechanism is fed to the spinning rotor 11. The individual fibers arrive on the inner wall 110 and slide along this as far as the collecting groove 111 where they are deposited in the form of a ring of fiber. In the extension 130 to the cover there is further a yarn draw-off tube 31, through which an end of yarn 41 (FIG.4) is introduced into the interior of the spinning rotor 11 for joining, where because of the centrifugal force generated by the rotation of the spinning rotor 11 it arrives in the collecting groove 111. Thereupon the yarn 41 is drawn off, so that the fibers in the fiber ring become bound into the end of the yarn. The drawn-off yarn 41 is wound up onto a bobbin (not shown).

In the case of the spinning process described trash also arrives in the interior of the spinning rotor 11 with the individual fibers, which primarily is deposited in the collecting groove 111. In the spinning of cotton these deposits consist of dust, sand, fiber fragments and vegetable matter and when the trash collects in the form of points in the rotor it causes a moire effect. When the trash is annularly deposited in the rotor, a rough surface to the yarn 41 is produced.

In the case of the spinning of man made fibers the coatings originate especially in fiber finish and greases as well as fiber fragments collect and lead to a moire effect or a reduction in quality through alterations of the surface of the yarn 41, which may also lead to yarn breakages.

Fine dust, fiber finish and particles of dye are furthermore deposited on the inner periphery of the spinning rotor 11, especially outside the slip region traversed by the individual fibers in proximity to the open edge 112 of the spinning rotor 11. This deposit occurs because the air together with the dust gets sucked away over the edge 112 of the rotor. When the layer deposited in proximity to the edge 112 of the rotor has become thick enough it flakes off from time to time and gets into the collecting groove 111 where it may again lead to trouble in the form of moire effect or rough yarn or even to yarn breakages.

The necessity therefore exists of cleaning from the spinning rotors 11 at certain intervals of time the deposits which build up. The cleaning devices hitherto applied industrially provide for mechanical cleaning with subsequent pneumatic conveyance of the loosened trash away. But mechanical devices of that kind are very sensitive and therefore also have to be adjusted frequently. Above all their application is only possible when the rotor r.p.m. is reduced to a certain residual low r.p.m. Since in this case the adjacent spinning stations must at the same time be reduced in their r.p.m. because of the usual common drive this means a considerable loss of production if a large number of spinning rotors 11 are to be cleaned or all of them after another.

Figure 1:
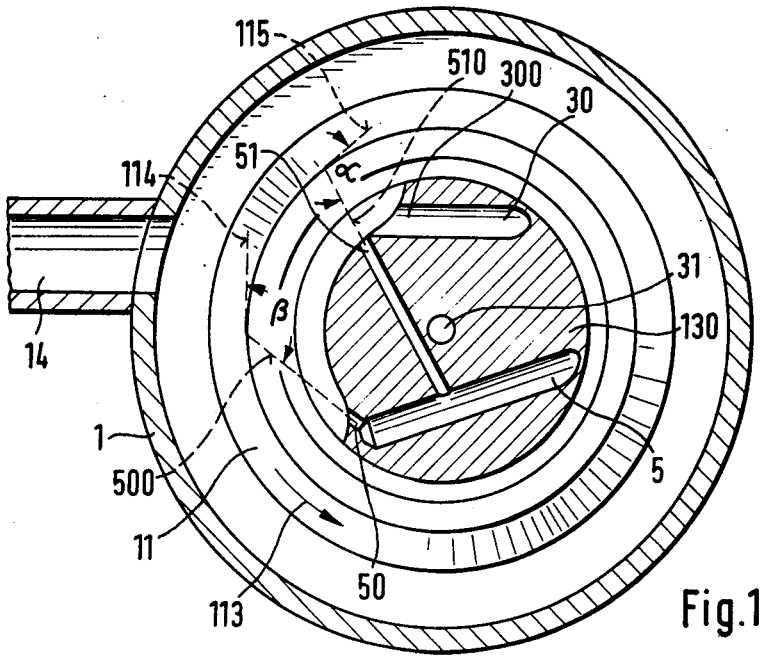
FIG. 1 is a cross-sectional view taken through the housing in which a spinning rotor is carried illustrating an extension from a cover in section.

All of these advantages are avoided by means of the method in accordance with the invention and the device in accordance with the invention. For this purpose at reduced rotor r.p.m. a flow of cleaning air is directed at the collecting groove 111 of the spinning rotor 11. A second flow of cleaning air which is likewise directed at the inner periphery of the spinning rotor 11 at another angle, moreover backs up the first flow of cleaning air. Directly after the action of the first flow of cleaning air the trash is subjected to the action of the second flow of cleaning air, thereby it gets positively loosened from the inner wall 110 of the spinning rotor 11. Now it can in known manner be carried away through the cover 13, through the shank 12 of the spinning rotor 11 which is made for this purpose as a hollow shank, or over the open edge 112 of the rotor between the spinning rotor 11 and the cover 13 into the housing 1 by a suction air pipe 14 connected to it (FIG. 1). The reduced r.p.m. does not need to be constant but may also be decreasing so that the cleaning can take place during the individual braking of the spinning rotor 11.

The device shown in FIG. 1 shows the spinning rotor 11 in a plan view and the housing 1 shown in cross-section. The extension 130 to the cover projects into the open side of the spinning rotor 11, and is shown in section along the planes of the fiber feed channel 30 as well as a compressed air duct 5. The compressed air duct 5 ends in a mouth 50 which is directed at an angle $\beta$ towards the inner wall 110 of the spinning rotor 11, where this angle is measured between the direction of the air feed 500 and the tangent 114 which is applied against the direction of rotation of the spinning rotor 11, marked by an arrow 113. A further mouth 51 is connected to the compressed air duct 5, the direction of air feed 510 of which includes an angle $\alpha$ with a tangent 115 applied in the manner described to the spinning rotor 11. As FIG. 1 clearly shows, the angle $\alpha$ is smaller than the angle $\beta$. Through these different angles of impingement of the flows of cleaning air a significant intensification of the cleaning effect is achieved. Further intensification is achieved if the air is fed pulsatingly, whereby any trash is loosened from the rotor wall with certainty.

Between the mouths 50 and 51 the extension 130 to the cover exhibits advantageously at the level of the open edge 112 of the rotor a greater clearance from the edge 112 of the rotor than along the remainder of its periphery. This greater clearance is made as an undercut 131 in which in the embodiment shown the mouth 300 of the fiber feed channel 30 terminates. In this way the extension 130 to the cover forms by its undercut 131 at the same time a separator which in spinning service separates the fed-in individual fibers from the yarn 41 grasped in the draw-off.

The undercut 131 or the greater clearance of the extension 130 to the cover from the edge 112 of the rotor facilitates the carrying away of the loosened trash which partially by the cover pressure of the flows of cleaning air and partially also by the air sucked away through the suction pipe 14, gets directed over the open edge 110 of the rotor.

Figure 2:
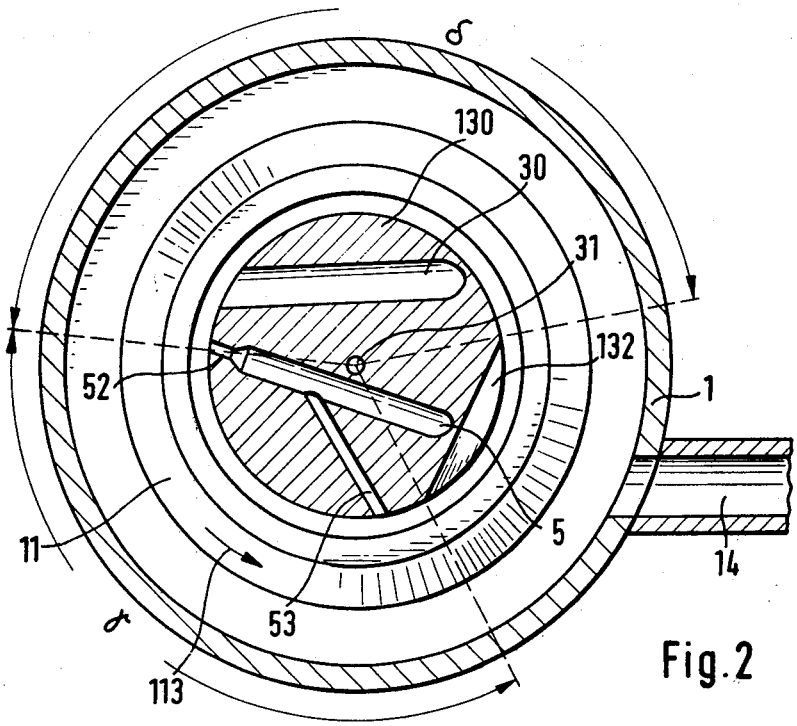
FIG. 2 is a cross-sectional view of a modified form of the device shown in FIG. 1.

It is particularly advantageous if the two flows of cleaning air are directed in divergent directions into the spinning rotor 11. Such an embodiment is shown in FIGS. 2 and 3. In this case two mouths 52 and 53 are connected to the compressed air duct 5, of which the mouth 52 is orientated against the direction of rotation of the spinning rotor 11 marked by the arrow 113 and the mouth 53 is oriented in the direction of rotation of the spinning rotor 11. The two mouths 52 and 53 are in that case arranged essentially in divergent directions at an obtuse angle to one another. The two flows of cleaning air fed through these mouths 52 and 53 supplement each other in an outstanding way in the loosening of the dirty matter, since the one air flow acts against and the other air flow with the direction of rotation of the spinning rotor 11.

In the case of this embodiment of the invention it is advantageous too if for facilitating the carrying away of the loosened dirty matter the extension 130 to the cover exhibits along one part of its periphery at the level of the edge 112 of the rotor a greater clearance from it than along the remainder of its periphery. It is advantageous if this widening of clearance 132 lies opposite the bisector of the angle included between the mouths 52 and 53 (with the yarn draw-off tube as apex). Because of the fiber feed tube 30 this as a rule is not possible and one has to strive to arrange this widening of clearance 132 at the obtuse angle $\gamma$ or $\delta$ to at least one of the mouths 52 or 53.

In order to also loosen the trash deposited in proximity to the edge 112 of the rotor, in accordance with the embodiment shown in FIG. 3, the mouth 53 is directed not into the collecting groove 111 but onto the inner wall in proximity to the open edge 112 of the rotor. If two mouths 50 and 51 are provided, which are oriented in the same circumferential direction, a third mouth (not shown) is advantageously provided for the cleaning of the edge 112 of the rotor.

Figure 4:
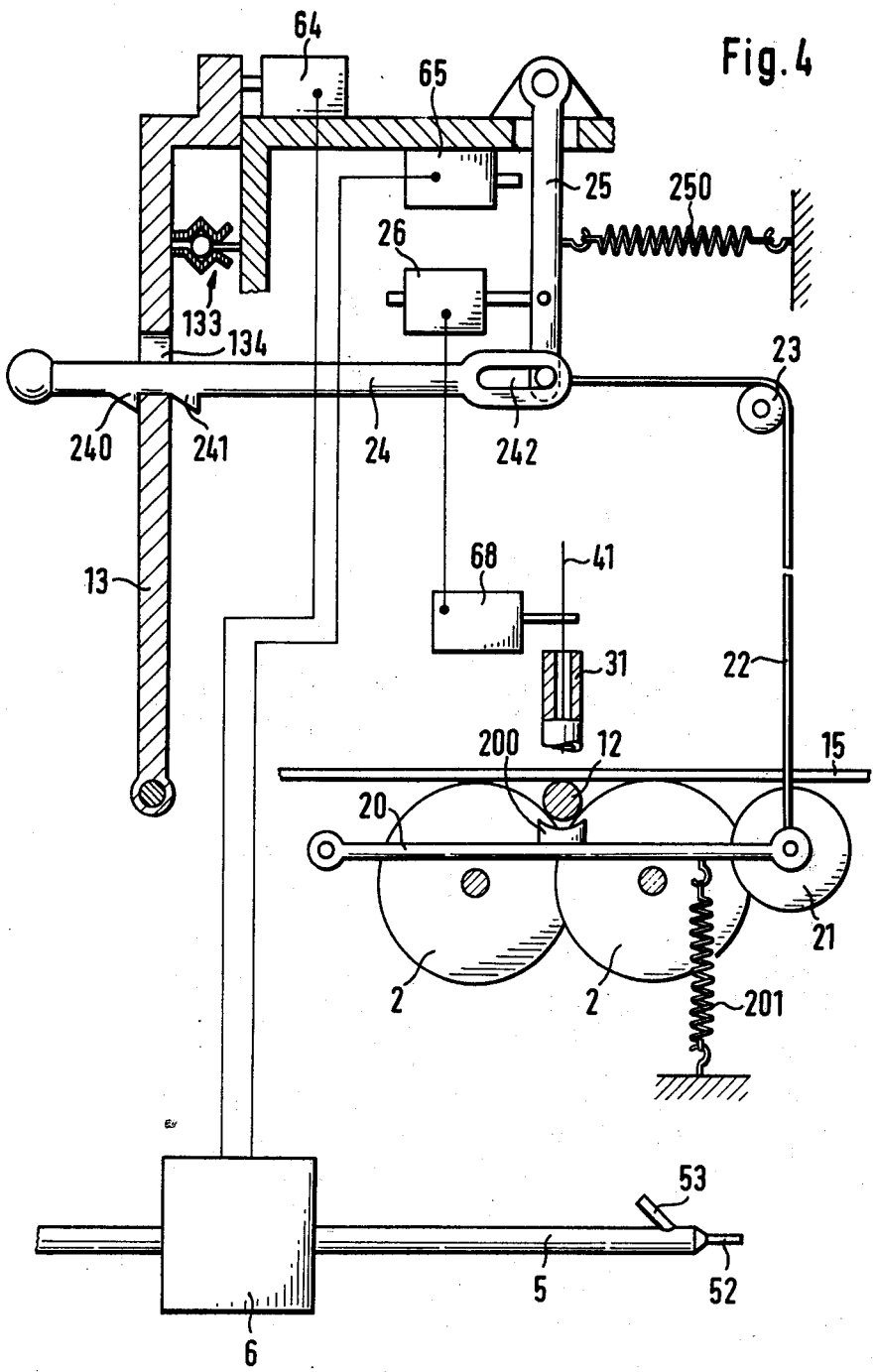
FIG. 4 is a diagramatic illustration of control devices used in conjunction with the cleaning mechanism constructed in accordance with the present invention.

Since the mouths 50 and 51 or 52 and 53, respectively are arranged in the cover 13 or in the extension 130 to the cover respectively, the cleaning device can exercise its cleaning function only with the cover 13 closed. In order to avoid disturbances in the silver or in adjoining spinning stations, in accordance with one embodiment of the invention, the cleaning device is prevented from being able to become effective as long as the cover 13 is open. As shown in FIG. 4, a switch 64 is consequently associated with the cover 13, which is closed with the cover 13 locked in position.

Figure 5:
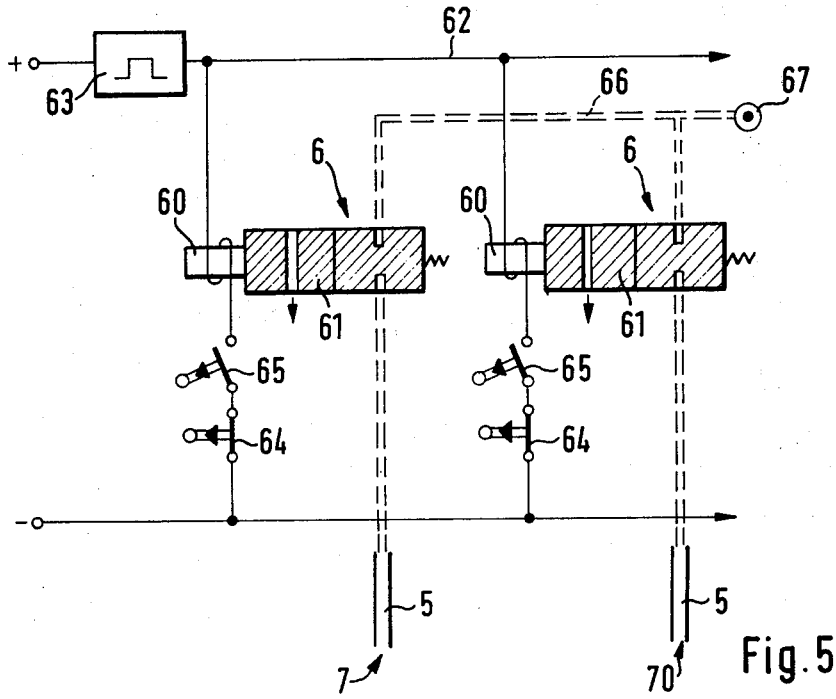
FIG. 5 is a schematic diagram illustrating connections for electricl and pneumatic switching devices utilized in cleaning devices constructed in accordance with the present invention.

The circuit arrangement of the device in accordance with the invention is shown in FIG. 5. A common compressed air control device 6 is assiciated with the compressed air duct 5 for the mouths 50 and 51 or 52 and 53, respectively, which consists of an electromagnet 60 and a pneumatic valve 61.

In the case of a plurality of spinning stations 7, 70 . . . the individual electromagnets 60 are connected to a common control lead 62 in which there is a pulse generator 63. In series with the electromagnet 60 of each spinning station 7, 70 . . . there is the switch 64 already mentioned, controlled from the cover 13, and a further switch 65 is the control switch for triggering the cleaning process.

The compressed air ducts 5 are connected via the pneumatic valves 61 and a common compressed air pipe 66 to a compressed air source 67.

If the open-end spinning machine or mechanism is in service the pulse generator 63 emits pulses continuously at a frequency such that it is ensured pulses are emitted during a braking process independently of the start of the cleaning process. Since in service the cover 13 is in its closed position the switch 64 is also closed so that the device is ready for cleaning. If cleaning is now to be done, the spinning rotor 11 is braked in known manner and at the same time the switch 65 is closed. The electromagnet 60 of the spinning station 7, 70 . . . concerned is excited and opens the associated pneumatic valve 61 with the rhythm of the pulses emitted by the pulse generator 63, so that pulsating cleaning air is fed to the mouths 50 and 51 or 52 and 53, respectively.

Preferably, the electromagnet 60 is provided with a time control so that after a certain time when the spinning rotor 11 has with certainty come to a standstill, the pneumatic valve 61 closes agan so that the feed of pulsating cleaning air into the spinning rotor 11 is cut off.

A diagrammtic illustration of a preferred embodiment is shown in FIG. 4, where for the sake of better illustration no regard has been paid to the spaced arrangement of the individual parts.

The cover 13 is held by a catch mechanism 133 in its closed position in which it holds the switch 64 closed. The cover 13 covers over the usual feeding and opening mechanism (not shown) and the spinning rotor 11 which is supported by its shank 12 in the crotch between supporting disks 2. A brake-block 200 arranged on a rocking lever 20 is associated with the shank 12. To the free end of the rocking lever which carries a roller 21 is fastened the end of a Bowden wire 22 which is guided over a roller 23 and connected to the end of a draw lever 24. The draw lever 24 is hinged to the free end of a rocking lever 25 which, in turn, is suitably supported in such a way that it enables longitudinal motion of the draw lever 24. A tension spring 250 is associated with the rocking lever 25, which pulls the draw lever 24 back into its basic position in which the brake-block 200 is positioned away from the shank 12. The same purpose is served by a tension spring 201 which acts upon the rocking lever 20.

The draw lever 24 extends through an opening 134 in the cover 13 and exhibits two lugs 240 and 241 by which it can be connected positively to the cover 13.

If the cover 13 is opened, the draw lever 24 connected to the cover by its lug 240 is pulled and by it via the Bowden wire 22 and the rocking lever 20, the brake-block 200 is applied to the shank 12 of the spinning rotor 11 and raises the shank 12 out of the crotch between the supporting disks 2.

At the same time the roller 21 raises the driving belt 15 from the shank 12. Hence the spinning rotor 11 gets rapidly braked. In order not to have to control the compressed air control device 6 by hand via a separate switch, the aforesaid switch 65 is associated with the rocking lever 25 which follows likewise the motion of the draw-lever 13. But since upon opening the cover the switch 64 was opened, the rotor cleaning remains ineffective.

If on the contrary, the draw lever 24 is actuated with the cover 13 closed and it is locked by its lug 241 to the cover 13, the spinning rotor 11 gets braked in the way described and the switch 65 is also activated. Since now the switch 64 too is closed by the cover 13, one or more spurts of compressed cleaning air are directed into the spinning rotor 11, whilst the spinning rotor 11 is being braked. Hence the spinning rotor 11 gets cleaned in the way described.

For cleaning the spinning rotor 11 manual intervention by the operator is not necessary. For this reason in accordance with a preferred embodiment of the invention the yarn monitor 68 usually provided is connected via the brake mechanism controlwise to the compressed air control device 6. In the case of the embodiment of the device shown in FIG. 4 an electromagnet 26 is associated with the rocking lever 25, which can pivot the rocking lever 25 and via the Bowden wire 22 also the rocking lever 20 against the action of the tension springs 250 and 201.

For this purpose the draw lever 24 is hinged to the rocking lever 25 by means of an elongated hole 242 which extends in the direction longitudinal to the draw lever 24, so that the rocking lever 25 may be actuated independently of a motion of the draw lever 24.

Hence, if a yarn breakage occurs so that the yarn tension in the region of the yarn monitor 68 drops it emits a switching pulse to the electromagnet 26 which swings over the rocking lever 25. Via the Bowden wire 22 this actuates the rocking lever 20 so that the spinning rotor 11 is brought to a standstill. At the same time the switch 65 is actuated, which operates the compressed air control device 6 so that the compressed air feed is connected into the interior of the spinning rotor 11.

In the event of a yarn breakage, through the breaking of the yarn 41 as a rule a more or less compact ring of fibers is normally chopped up by the pulsating feed of a flow of cleaning air or of both air flows and can therefore easily be carried away out of the spinning rotor.

It is not absolutely necessary that the individual cleaning of the spinning rotor 11 independently of yarn breakages be initiated by a draw lever 24. For example, a push button might also be provided, which is connected to the electromagnet 26

It is also not absolutely necessary that the cover 13 in which the mouths 50, 51 or 52, 53 respectively, are arranged is the cover by which the housing holding the spinning rotor 11 is closed during spinning service. For example, the cover 13 may also be formed by a maintenance device which substitutes the stationary cover of the housing during the maintenance phase. This maintenance device may in that case be individual to each spinning station or provided as a traveling device for a plurality of spinning stations. In this maintenance device a suction air opening may also be provided for carrying away the loosened trash. Since upon opening the cover of the housing the spinning rotor 11 is normally brought to a standstill, starting up of the spinning rotor 11 again may be controlled by this maintenance devive, since for cleaning the spinning rotor 11 a relative speed between the spinning rotor 11 and the mouths 50, 51 or 52, 53 of the compressed air duct 5 is necessary.

Figure 6:
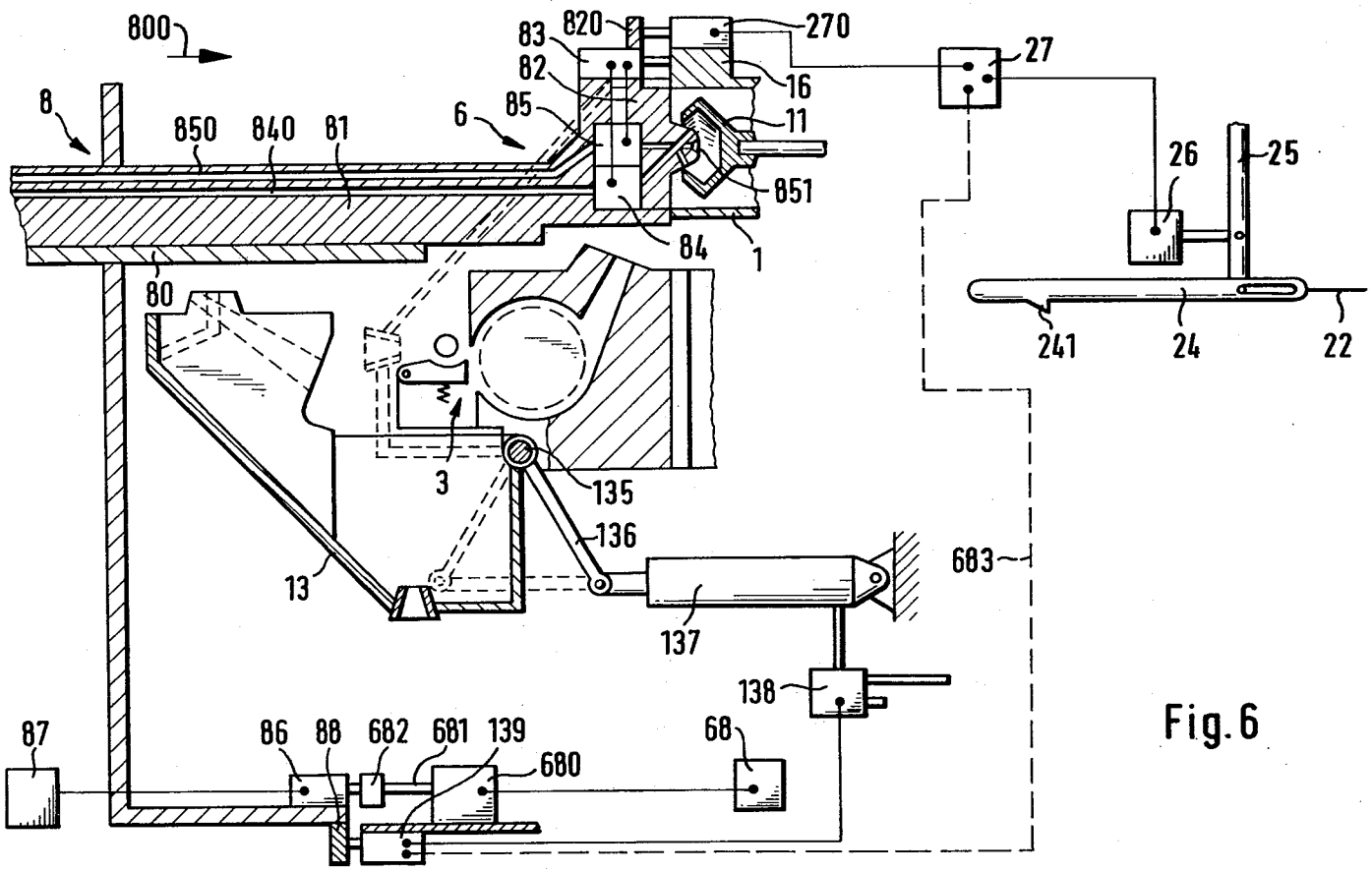
FIG. 6 illustrates in cross-section an auxiliary servicing device for cleaning the rotor of a spinning machine.

An example of a device in which the cover is formed by a maintenance device 8 is shown in FIG. 6. The feed and opening roll 3 as well as the spinning rotor 11 are covered over during spinning service by a cover 13 which then adopts the position shown in dotted lines. The cover 13 which is pivotable about a pin 135 exhibits an arm 136 which is connected to a control cylinder 137 which in a suitable way is fastened to the machine frame. The control cylinder 137 is connected via a valve 138 to a switch 139 which may be actuated by a switching lug 88 provided on the maintenance device 8.

The yarn monitor 68 is arranged in known manner in the cover 13 is connected to an electromagnet 680, the core 681 of which carries a switching lug 682. By means of the switching lug 682 a switch 86 which is connected to the maintenance device 8 may be actuated, which switches on a control device 87.

The maintenance device 8 exhibits a rail 80, along which a holder 81 with a cover 82 may be moved. The cover 82 carries a switch 83 which may be actuated by a switching lug 16 fastened to the housing 1. The switch 83 is connected to two valves 84 and 85. The valve 84 controls the air feed via a compressed air pipe 840 into the spinning rotor 11, while the valve 85 connects a suction pipe 850 via a suction bell 851 in the cover 82 to the interior of the spinning rotor 11.

The cover 82 further carries a switching lug 820 for actuation of a switch 270 carried by the housing 1, which is connected to a control device 27 which, in turn, is connected to the electromagnet 26.

Upon the occurrence of a yarn breakage the yarn monitor 68 is actuated, which, in turn, excites the electromagnet 680, which by means of its core 681 shifts the switching lug 682 into the operating position. The maintenance device 8 which either runs periodically down all of the spinning stations or is called by the yarn monitor 68 to the disturbed spinning station in a way which is known and is therefore not shown, is stopped before reaching the cleaning position by actuation of the switch 86 by means of the switching lug 682.

For this purpose the switch 86 delivers a corresponding pulse to the control device 87 which in a manner not shown controls the drive of the individual units of the maintenance device 8. Simultaneously with the actuation of the switch 86 the switch 139 is actuated by the switching lug 88. This switch 139 operates the valve 138 which brings it about that the cover 13 is swung out of the position shown dotted into the position shown in solid line.

After a pre-programmed time the control device 86 sets the maintenance device 8 again in motion, which is now run into the operation position and stopped there. In this case, the switch 139 remains actuated, so that the cover 13 remains in its open position. In the operation position the control device 87 via means not shown displaces the holder 81 with the cover 82 in the direction of the arrow 800 until the cover 82 is lying tightly against the housing 1. In this position the switching lug 820 actuates the switch 270 which via the control device 27 and the electromagnet 26 actuates the rocking lever 25 and hence in the way already described brakes the spinning rotor 11. At the same time the switching lug 16 actuates the switch 83 which via the valve 84 connects the compressed air feed into the spinning rotor 11 and connects the suction via the valve 85. After a certain period the control device 87 brings about the withdrawal of the holder 81, so that the switches 83 and 270 are released. The spinning rotor 11 starts up again, whilst the valves 84 and 85 for the air feed and exhaust are closed. After complete withdrawal of the holder 81 the control device 87 sets the maintenance device 8 again in motion.

Finally the switching lug 88 releases the switch 139, whereby it is brought about that via the valve 138 and the control cylinder 137 the cover 13 is again brought into its operation position.

In order to avoid that the spinning rotor 11 can rotate with the cover 13 open, the control device 27 may be connected via a lead 683 to the switch 139 or else to the yarn monitor 68, in which case the switch 270 can via the control device 27 bring about temporary driving of the spinning rotor 11.

As the preceding description shows, the object of the invention can be modified in many ways. Also more than two flows of cleaning air can be directed into the spinning rotor 11. If a flow of cleaning air is directed onto the inner wall 110 of the spinning rotor 11 in proximity to the edge 112 of the rotor, this flow of cleaning air is preferably directed into the spinning rotor in the direction of rotation marked by the arrow 13, while the air flow directed into the collecting groove 111 arrives in the spinning rotor 11 in the opposite direction.

The pulsating flows of cleaning air introduced into the spinning rotor 11 destroy the ring of fibers and yarn residue which are possibly still present, so that these may easily be carried away out of the spinning rotor 11 together with the other loosened trash. The loosening and carrying away of the trash is effected in the slowing-down phase of the spinning rotor 11 and is finished upon the rotor coming to rest.

If knots of fibers should actually occur, these can escape from the interior of the spinning rotor 11 at the point at which the extension 130 on the cover exhibits a greater clearance from the edge 112 of the rotor.

Rotor cleaning always takes place when the spinning process is interrupted for any reason. This may be the case with yarn breakage occuring at random, when joining up again after elimination of yarn faults, thin places, thick places, moire effect, at regular intervals of time, e.g., at bobbin changes or at shift changes, or within the scope of the general shutdown or start-up after a stoppage of the machine or upon changing the sliver. The actual joining is effected in the usual way.

The method in accordance with the invention and the device in accordance with the invention are safe in operation and need no adjustments since wear as with mechanical cleaning elements does not occur. Also, in the case of exchange of the spining rotor 11 for a spinning rotor 11 of another diameter adaptation of the cleaning device is not necessary. The object of the present invention is thereby usable also universally.

While a preferred embodiment of the invention has been described using specific terms, such description is for illustrative purposes only, and it is to be understood that changes and variations may be made without departing from the spirit or scope of the following claims.

What is claimed is:

1. A method of cleaning a rotor in an open-end spinning machine which is rotated at a running r.p.m. during the spinning operation, said rotor having a collecting groove and an inner periphery, said method comprising the following steps:

reducing the speed of rotation of said rotor below its running r.p.m.;

directing a first flow of cleaning air at said collecting groove of said rotor at a first angle;

directing a second flow of cleaning air at said inner periphery of said spinning rotor at a second angle;

said first and said second flows of air being directed into said spinning rotor in divergent directions so that one of said flows is directed in the direction of rotation of the spinning rotor and the other of said flows is directed against the direction of rotation of the spinning rotor;

whereby said first and second flows of air dislodge trash from said rotor.

2. A method of cleaning a rotor in an open-end spinning machine which is rotated at a running r.p.m. during the spinning operation, said rotor having a collecting groove and an inner periphery, said method comprising the following steps:

rotating said rotor below its running r.p.m.;

directing a first flow of cleaning air at said collecting groove of said rotor at a first angle;

directing a second flow of cleaning air at said inner periphery of said spinning rotor at a second angle;

said first and second flows of air being directed into said spinning rotor in divergent directions so that one of said flows is directed in the direction of rotation of the spinning rotor and the other of said flows is directed against the direction of rotation of the spinning rotor;

whereby said first and second flows of air dislodge trash from said rotor.

3. A device for cleaning a rotor in an open-end spinning machine, said rotor having a collecting groove and an inner periphery, said device comprising:

a source of compressed air;

a first duct extending into said rotor terminating in a mouth directed towards said collecting groove of said rotor;

a second duct extending into said rotor terminating in a mouth directed towards said inner periphery of said spinning rotor; and means for connecting said source of compressed air to said first and second ducts producing streams of air directed at said inner periphery and collecting groove for dislodging trash therefrom;

said two mouths directing said streams of air in divergent directions so that one of said streams is directed in the direction of rotation of the spinning rotor and the other of said streams is directed against the direction of rotation of the spinning rotor.

4. The device as set forth in claim 3 wherein said rotor has an open edge, further comprising:

said mouth of said second duct directing said stream of air towards said open edge of said rotor.

5. A device for cleaning a rotor of an open-end spinning machine, said rotor having a collecting groove and an inner periphery which terminates in an edge adjacent an opened side of said rotor, a cover extending over the front of said rotor adjacent said open side having an extension extending in said rotor from said open side, said device comprising:

a source of compressed air;

a first duct extending into said rotor terminating in a mouth directed towards said collecting groove;

a second duct extending into said rotor terminating in a mouth directed towards said inner periphery of said rotor;

means for connecting said source of compressed air to said first and second ducts producing stream of air directed at said inner periphery and collecting groove for dislodging trash therefrom; and a portion of said extension exhibiting a greater clearance for said edge of said rotor than the remainder of the periphery of said extension.

6. The device as set forth in claim 5 further comprising:

said portion of said extension exhibiting a greater clearance from said edge of said rotor being located at an obtuse angle to at least one of said mouths.

7. The device as set forth in claim 6 further comprising:

said portion of said extension exhibiting a greater clearance from said edge of said rotor being produced by an undercut in a side of said extension adjacent said edge of said rotor.

8. The device as set forth in claim 7 wherein a fiber feed channel extends through said extension terminating in a mouth for feeding fibers to said rotor, said device further comprising:

said undercut being positioned adjacent said mouth of said feed channel.

9. The device as set forth in claim 5 further comprising:

a valve connected between said source of compressed air and said ducts for controlling the flow of compressed air to said ducts, switch means operably connected to said cover and said valve for opening said valve when said cover is closed for supplying compressed air to said ducts and closing said valve when said cover is opened.

10. The device as set forth in claim 5 wherein a brake mechanism is associated with said rotor, further comprising:

a valve connected between said source of compressed air and said ducts for controlling the flow of compressed air to said ducts;

switch means operably connected to said brake mechanism and said valve for opening said valve when said brake mechanism is activated for supplying compressed air to said ducts.

11. The device as set forth in claim 10 wherein a yarn monitor is provided for monitoring the tension in the yarn being produced in said rotor, further comprising:

means operably connecting said yarn monitor to said brake mechanism for activating said brake mechanism and said switch operably connected thereto for supplying compressed air to said ducts responsive to a change in tension in said yarn.

12. A device for cleaning a rotor in an open-end spinning machine, said rotor having a collecting groove, an inner periphery and an open side, a removable cover extending over said open side, said device comprising:

a source of compressed air;

a movable housing having an end portion adapted to be inserted in said rotor;

a first duct provided in said end portion and terminating in a mouth directed towards said collecting chamber when said end portion is inserted in said rotor;

a second duct provided in said end portion and terminating in a mouth directed towards said inner periphery of said rotor when said end portion is inserted in said rotor; and means for connecting said source of compressed air to said first and second ducts producing streams of air directed at said inner periphery and said collecting groove for dislodging trash therefrom;

said two mouths directing said streams of air in divergent directions so that one of said streams is directed in the direction of rotation of the spinning rotor and the other of said streams is directed against the direction of rotation of the spinning rotor.

13. A device as set forth in claim 12 wherein a brake mechanism is associated with said rotor, further comprising:

a valve connected between said source of compressed air to said ducts;

switch means operably connected to said brake mechanism and said valve for opening said valve when said brake mechanism is activated for supplying compressed air to said duct.

14. A device for cleaning a rotor in an open-end spinning machine, said rotor having a collecting groove, an inner periphery, and an open side, a cover extending over said open side, said device comprising:

a source of compressed air;

a first duct extending into said rotor terminating in a mouth directed towards said collecting groove;

a second duct extending into said rotor terminating in a mouth directed towards said inner periphery of said rotor;

means for connecting said source of compressed air to said first and second ducts producing streams of air directed at said inner periphery and collecting groove for dislodging trash therefrom;

said two mouths directing said streams of air in divergent directions so that one of said streams is directed in the direction of rotation of the spinning rotor and the other of said streams is directed against the direction of rotation of the spinning rotor;

a valve connected between said source of compressed air and said ducts for controlling the flow of compressed air to said ducts; and switch means operably connected to said cover and said valve for opening said valve when said cover is closed for supplying compressed air to said ducts and closing said valve when said cover is opened.

15. A device for cleaning a rotor in an open-end spinning machine, said rotor having a collecting groove, an inner periphery and an open side, a cover extending over said open side, said device comprising:

a source of compressed air;

a first duct extending into said rotor terminating in a mouth directed towards said collecting groove;

a second duct extending into said rotor terminating in a mouth directed towards said inner periphery of said rotor;

means for connecting said source of compressed air to said first and second ducts producing streams of air directed at said inner periphery and collecting groove for dislodging trash therefrom;

said two mouths directing said streams of air in divergent directions so that one of said streams is directed in the direction of rotation of the spinning rotor and the other of said streams is directed against the direction of rotation of the spinning rotor;

a valve connected between said source of compressed air and said ducts for controlling the flow of compressed air to said ducts;

a brake mechanism associated with said rotor; and switch means operably connected to said brake mechanism and said valve for opening said valve when said brake mechanism is activated for supplying compressed air to said ducts.

16. The device as set forth in claim 15 wherein a yarn monitor is provided for monitoring the tension in the yarn being produced in said rotor, further comprising:

means operably connecting said yarn monitor to said brake mechanism for activating said brake mechanism and said switch operably connected thereto for supplying compressed air to said ducts responsive to a change in tension in said yarn.

17. A method of cleaning a rotor in an open-end spinning machine which is rotated at a running r.p.m. during the spinning operation, said rotor having a collecting groove and an inner periphery, said method comprising the following steps:

reducing the speed of rotation of said rotor below its running r.p.m.;

directing a first flow of cleaning air at said collecting groove of said rotor at a first angle; and pulsatingly directing a second flow of cleaning air at said inner periphery of said spinning rotor at a second angle;

whereby said first and second flows of air dislodge trash from said rotor.

18. A device for cleaning a rotor in an open-end spinning machine, said rotor having a collecting groove and an inner periphery, said device comprising:

a source of compressed air;

a first duct extending into said rotor terminating in a mouth directed towards said collecting groove of said rotor;

a second duct extending into said rotor terminating in a mouth directed towards said inner periphery of said spinning rotor;

said first mouth and said second mouth being directed into said rotor at different angles;

means for connecting said source of compressed air to said first and second ducts producing streams of air directed at said inner periphery and collecting groove for dislodging trash therefrom, and means for causing at least one of said streams of air to be pulsating.

* * * * *